US006019679A

United States Patent [19]

Lloyd

[11] Patent Number: 6,019,679

[45] Date of Patent: Feb. 1, 2000

[54] FIRE AND SMOKE DAMPER

[75] Inventor: William P. Lloyd, Hatboro, Pa.

[73] Assignee: Lloyd Industries, Warrington, Pa.

[21] Appl. No.: 09/188,797

[22] Filed: Nov. 9, 1998

[51] Int. Cl.[7] ..... A62C 2/12

[52] U.S. Cl. ..... 454/369; 251/314

[58] Field of Search ..... 454/369, 257, 454/357; 251/314

[56] References Cited

U.S. PATENT DOCUMENTS

| | | | |
|---|---|---|---|
| 4,113,232 | 9/1978 | Mccabe | 251/305 |
| 4,723,481 | 2/1988 | Hart et al. | 454/369 |
| 4,763,711 | 8/1988 | Hart et al. | 454/369 |
| 5,425,673 | 6/1995 | Mahlanen et al. | 454/369 |
| 5,810,662 | 9/1998 | Van Becelaere | 454/369 |

*Primary Examiner*—Harold Joyce
*Assistant Examiner*—Derek S. Boles
*Attorney, Agent, or Firm*—Joseph W. Molasky & Associates

[57] ABSTRACT

A fire and smoke damper includes a flat-coil spring actuator to rotate the blades included within the damper between the "normally open" position to the "closed" position when a fire or smoke condition occurs. The damper may include one or more blades, using a linkage connector to ensure simultaneous operation of each blade. The flat-coil spring is held under tension by an actuator (such as a fusible link) to maintain the blades in the "normally open" position. Once the spring is released, a pivot arrangement coupled between the spring and the blade(s) functions to quickly rotate the blade(s) into the closed position, thereby blocking the passage of smoke or fire. The blades may include blade seals to ensure a tight seal.

9 Claims, 6 Drawing Sheets

FIRE AND SMOKE DAMPER

BACKGROUND OF THE INVENTION

Field of the Invention

The present invention relates generally to a fire and smoke damper and, more particularly, to a spring-activated damper.

In all building environments, it is required to control the progress of fire and smoke throughout the building structure. The structures used to control the progress are defined as "dampers". These units may be only "fire dampers", "smoke dampers", or combination "fire and smoke dampers". Fire dampers have ratings specified in hours—commonly 1.5 hours and three hours. A "normally open" fire damper is installed in an air distribution system and is designed to close automatically upon the detection of heat so as to prevent migratory air flow and restrict the passage of flames from one side of the damper to the other.

Smoke control systems are intended to be activated during the early stages of a fire situation to maintain a "safe" environment by restricting the flow of smoke into exit passageways, or other "safe" designated areas of a building area. All fires produce smoke, which if not controlled, will spread, endangering life and property. Even when a fire is contained within a fire-resistive area, smoke can readily spread to adjacent areas through openings such as ducts and open doors. A smoke damper is a device located in areas such as ceiling and floor ducts to block the egress of smoke into adjacent areas. Conventional arrangements utilize a smoke detector to activate the damper, where the detector is coupled to a motor mechanism to control the operation of the damper. In some situations, however, the motor may fail to operate correctly, allowing the smoke to escape.

SUMMARY OF THE INVENTION

The present invention relates generally to a fire and smoke damper and, more particularly, to a spring-activated damper. A flat-coil spring is interconnected between a fusible link and a crank assembly. The crank assembly is coupled to the plurality of blades forming the damper. When actuated by the occurrence of fire or smoke, the flat-coil spring is released to as to cause the crank assembly to rotate and re-position the blades from the "normally open" to the "closed" position, thereby controlling the egress of the fire or smoke.

In accordance with the present invention, the damper may include any desired number of blades. An external actuator may be used, in some instances, in place of the fusible link actuation.

Other and further embodiments of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION OF THE PREFERRED EMBODIMENT

Figure 1:
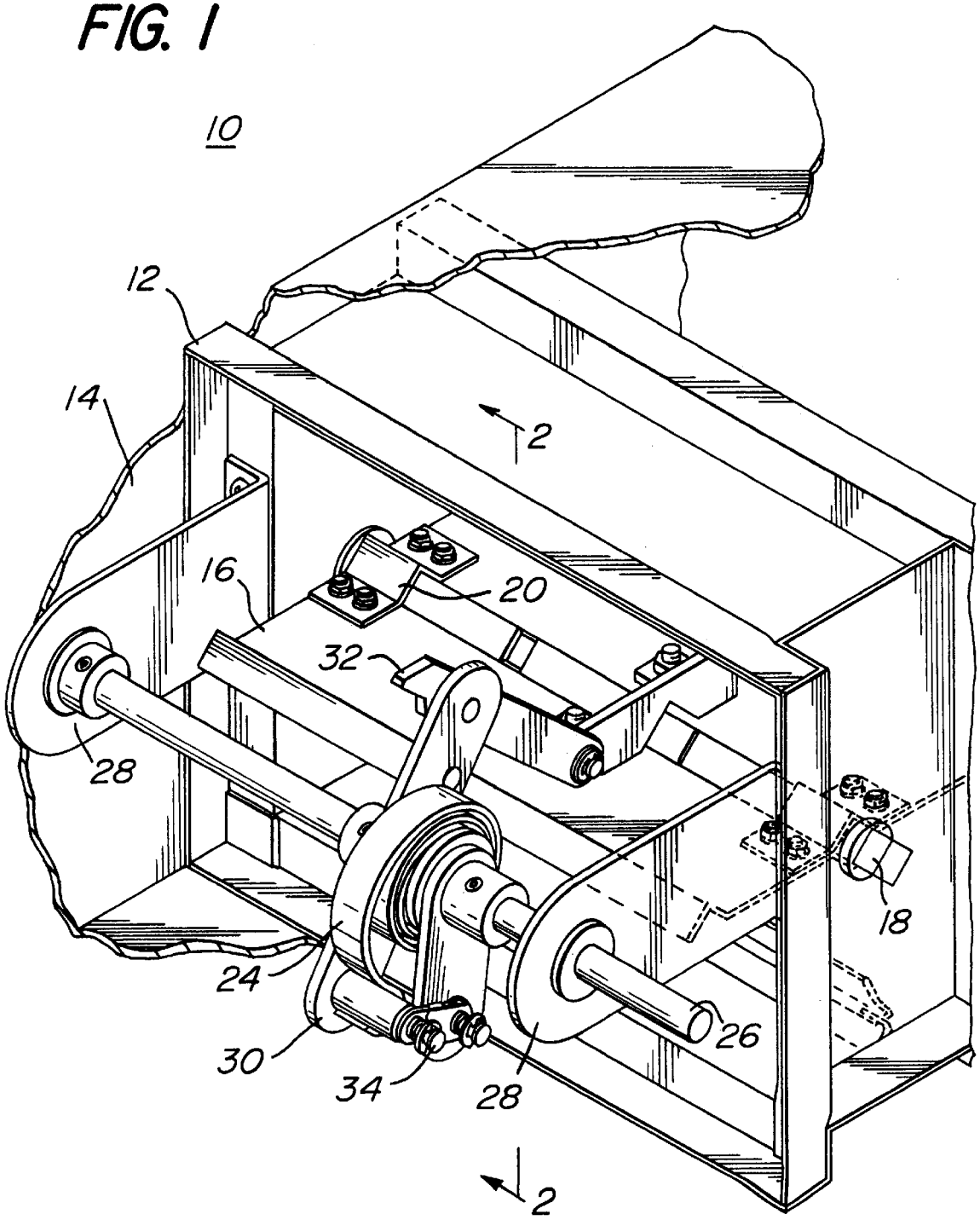
FIG. 1 is an isometric view of an exemplary embodiment of the present invention, including a single blade, the blade illustrated in the "normally open" position.

An exemplary smoke/fire damper 10 of the present invention is illustrated, in an isometric view, in FIG. 1. As shown, damper 10 comprises a frame 12, where frame 12 is sized to fit within an opening (for example, a duct or crawlspace) within a building structure 14. It is to be understood that the relative sizes of the various components comprising damper 10 will be determined as a function of the particular opening into which damper 10 will be inserted. The relative sizes are of no importance to the working of the invention.

Figure 2:
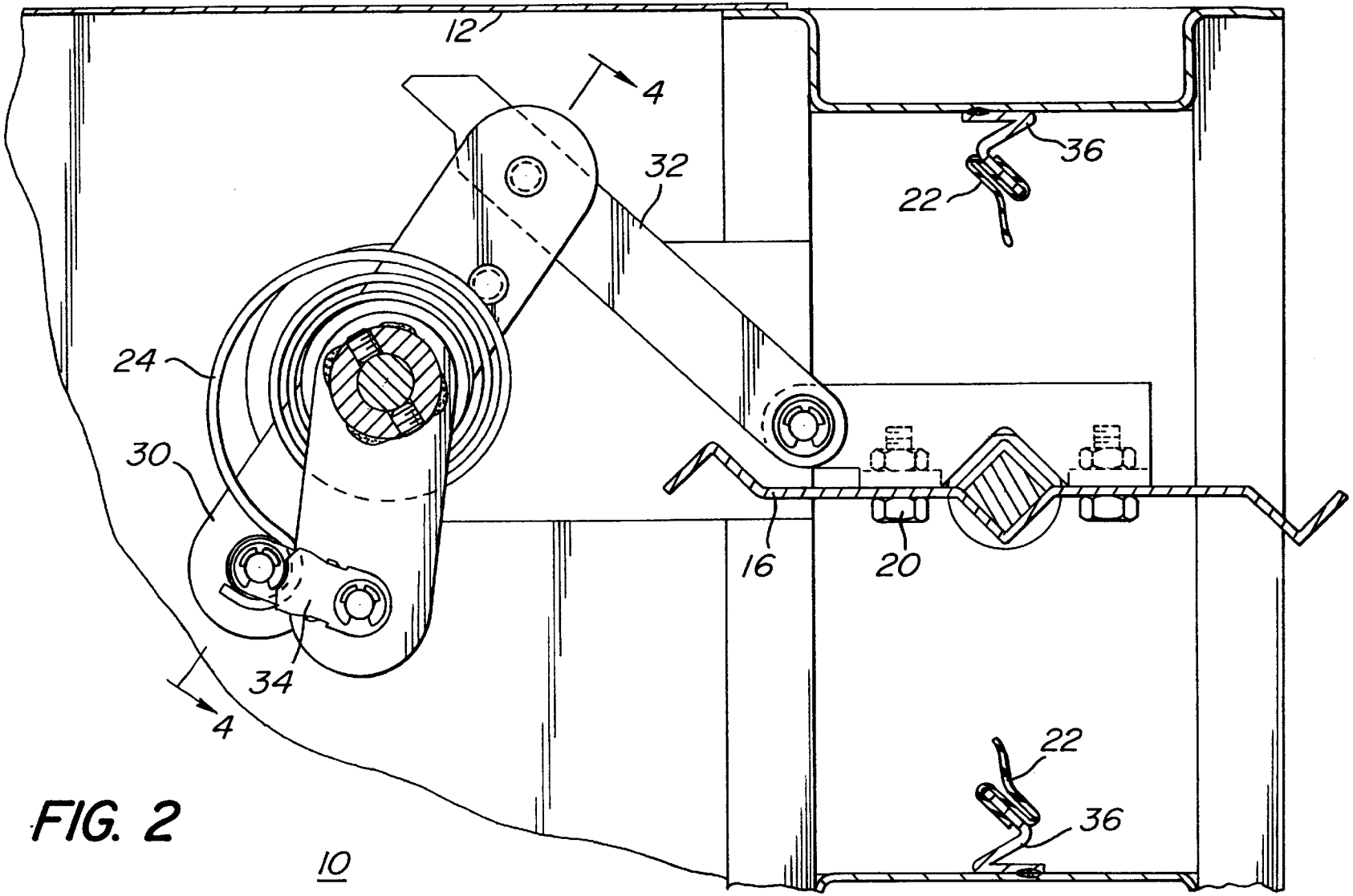
FIG. 2 is a partial side of the arrangement of FIG. 1, taken along line 2—2.

Disposed within frame 12 is a blade 16 which is attached to a central shaft 18. In the embodiment illustrated in FIG. 1, a pair of brackets 20 are used to attach blade 16 to shaft 18. Other attachment arrangements are possible and all are considered to fall within the spirit and scope of the present invention. In the arrangement as shown in FIG. 1, damper 10 is in the "normally open" position, with blade 16 parallel with the top and bottom surfaces of frame 12. With this blade orientation, air can easily pass through damper 10 without interruption. As will be discussed in detail below, upon the sensing of fire or smoke, blade 16 is rotated to as to be perpendicular to the top and bottom surfaces of frame 12. Blade 16 is designed to have a length capable of intersecting these surfaces when rotated and thereby cutting off the flow of smoke or flames beyond damper 10. FIG. 2, a cut-away side view of damper 10, illustrates the proper length of blade 16. As shown in FIG. 2, frame 12 may be formed to include a pair of stops 36, where stops will contact either end of blade 16 as it rotates into the closed position. In a preferred embodiment, as shown in FIG. 2, a blade seal 22 may disposed along the surfaces of the stops 36 to aid in creating an air-tight seal when the damper is in the "closed" position. Stainless steel and silicone blade seals have been found to provide a desired extra degree of closure when used with steel blades.

Figure 4:
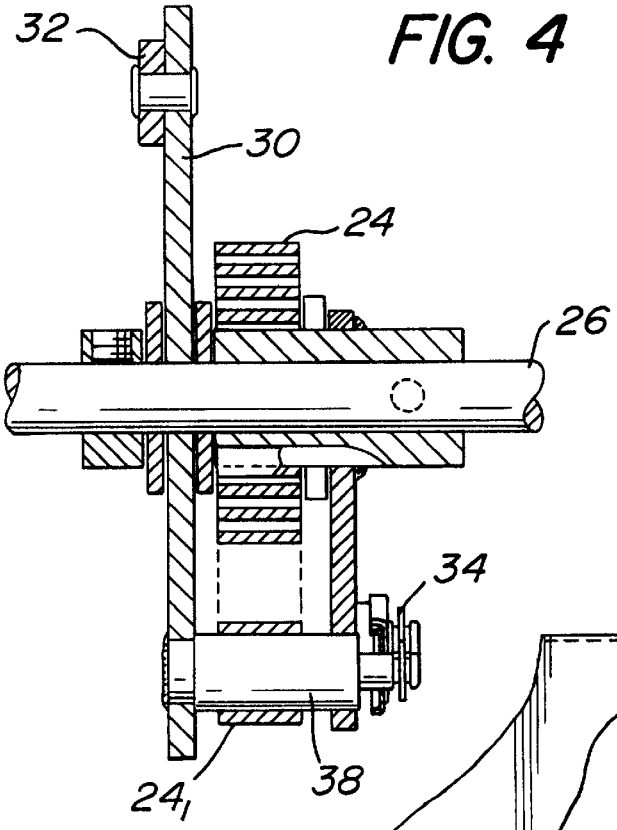
FIG. 4 is a partial side view of the flat-coil spring of the present invention, taken along line 4—4 of FIG. 2.

In accordance with the present invention, the movement of blade 16 to effect the closure of damper 10 is controlled by a flat-coil spring 24. Flat-coil spring 24 is wound onto an actuator rod 26. As shown in FIG. 1, actuator rod 26 is disposed a predetermined distance in front of frame 12 and is held in place by a pair of brackets 28 that are attached to frame 12 as shown. As will be seen in other views, a first end of flat-coil spring 24 is attached to actuator rod 26. The opposite end of flat-coil spring 24 is attached to a pivot arm 30, as shown in FIGS. 1 and 2. Pivot arm 30 is attached to a first end of a blade link 32,as shown in FIG. 4. Referring to FIG. 4, a first end $\mathbf{24}_1$ is disposed to engage an end rod portion 38 of pivot arm 30 where the opposite end of blade link 32 is attached to blade 16.

For the embodiment as illustrated in FIG. 1, a fusible link 34 is coupled between pivot arm 30 and actuator rod 26. This arrangement is also clearly illustrated in FIG. 2. As long as fusible link 34 is in place, flat-coil spring remains wound and under tension, maintaining blade 16 in its "normally open" position. In the presence of a sufficiently high ambient temperature, fusible link 34 will fail, allowing flat-coil spring 24 to unwind and thus rotate blade 16 into its "closed" position.

Figure 3:
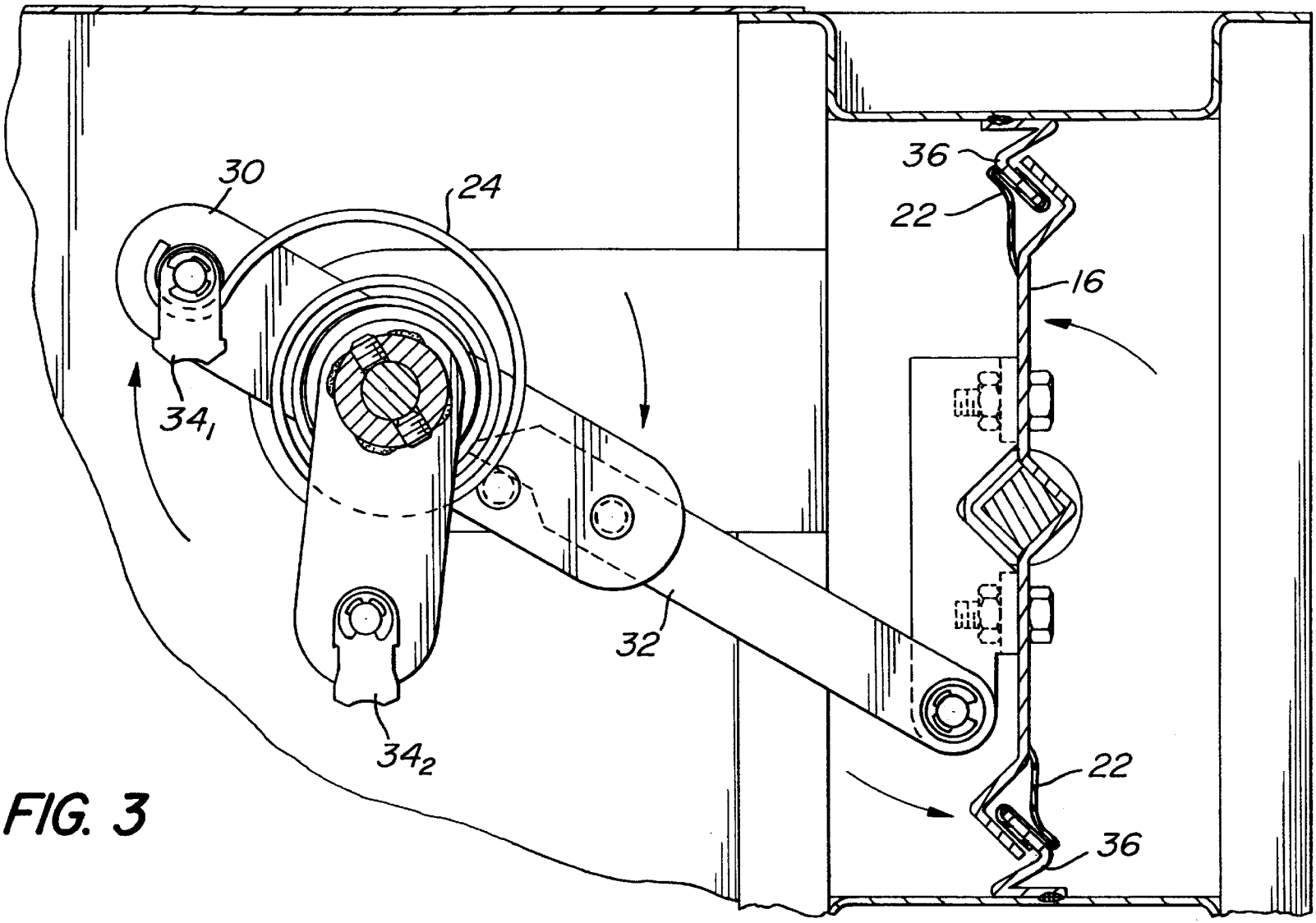
FIG. 3 is a partial side of the exemplary arrangement of the present invention, illustrating the actuation of the flat-coil spring and associated rotation of the blade into the "closed" position.

The "closed" position of damper 10 is shown in the partial cut-away side view of FIG. 3. As shown, fusible link 34 has now separated into two pieces, $\mathbf{34}_1$ and $\mathbf{34}_2$. When this occurs, the tension with flat-coil spring 24 is released such that pivot arm 30 will rotate in the direction indicated by the arrow in FIG. 3. Simultaneously, blade link 32 will rotate, causing blade 16 to rotate into the "closed" position as shown. FIG. 3 particularly shows the pair of stops 36 contacting either end of blade 16 as it rotates into the closed position. The stops 36 function both to prevent blade 16 from rotating past the desired horizontal (closed) position, while also adding to the integrity of the seal against the top and bottom surfaces of frame 16.

Figure 5:
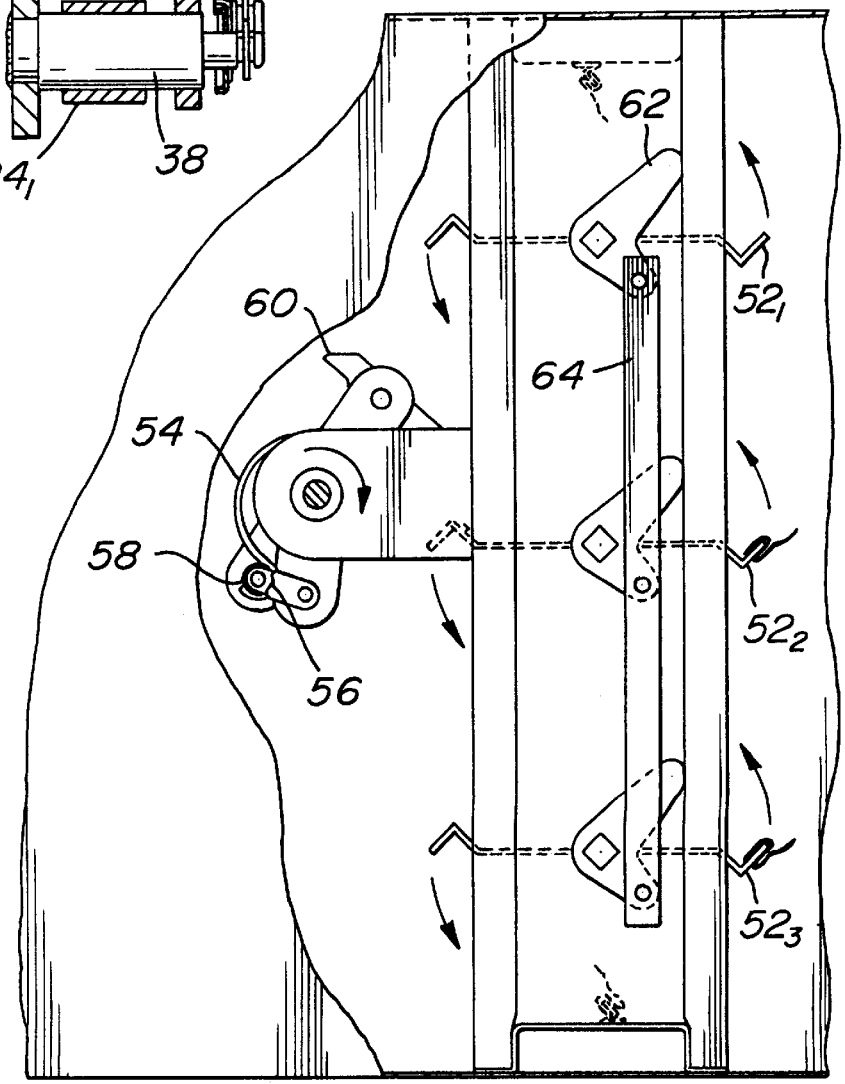
FIG. 5 is a cut-away side view of an alternative embodiment of the present invention, include a set of three blades within the damper.
Figure 6:
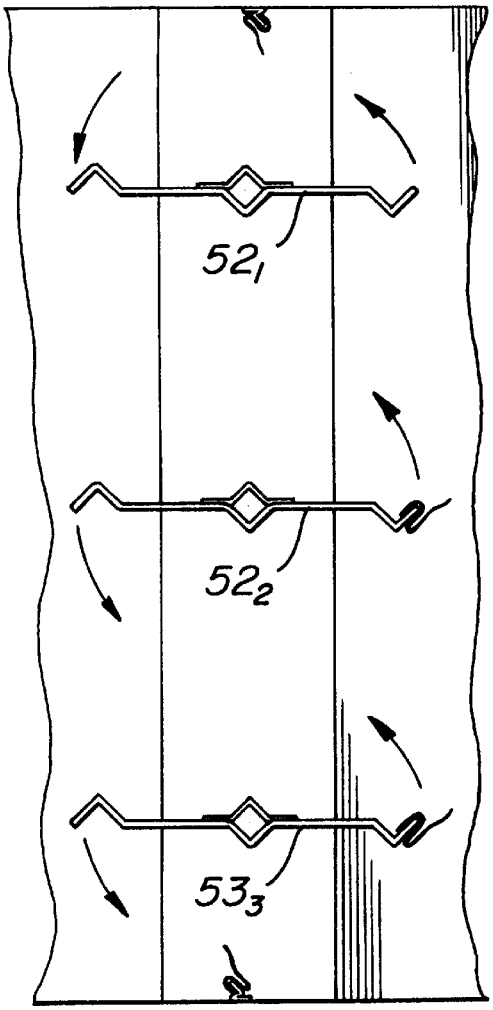
FIG. 6 is a simplified diagram of the three blades as shown in FIG. 5, in the "normally open" position, with arrows indicating the direction of rotation upon closure.
Figure 7:
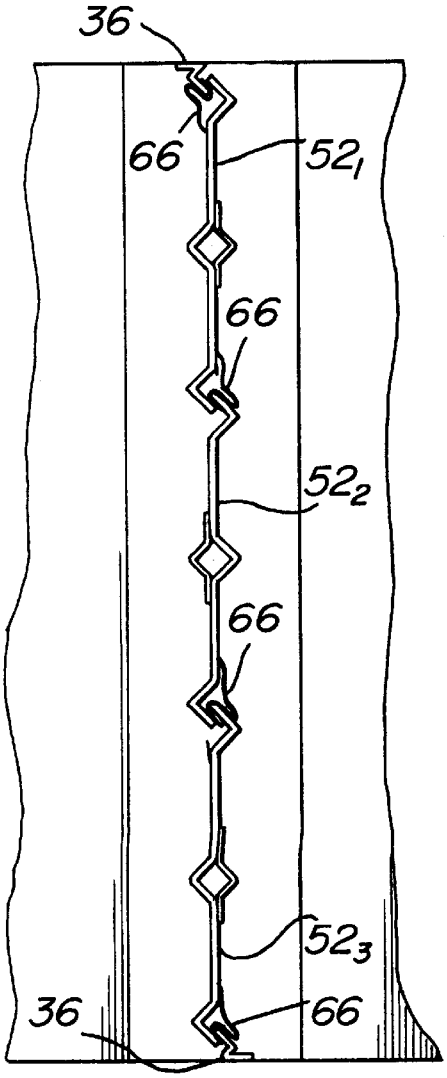
FIG. 7 is a simplified diagram of the three blades as in FIG. 6, with the blades rotated into the "closed" position.

As mentioned above, the damper of the present invention may include more than one blade. FIG. 5 is a cut-away side view of an exemplary damper 50 including a set of three blades, denoted $\mathbf{52}_1$, $\mathbf{52}_2$, and $\mathbf{52}_3$. As with the arrangement shown in FIG. 1, a flat-coil spring 54 is held under tension by a fusible link 56 so as to maintain all blades 52 in the "normally open" position. A first end $\mathbf{54}_1$ of flat-coil spring 54 is in contact with a pivot arm 58, where arm 58 is in turn coupled to a blade link 60. A link lever assembly 62 and connecting bar 64 are coupled to each blade 52 to ensure that all blades move simultaneously. In particular, FIG. 6 illustrates the set of three blades 52 in the "normally open" position. The re-positioning of blades 52 to the closed position, as actuated by the movement of flat-coil spring 54 is shown in FIG. 7. In this embodiment, the blade seal 66 is useful in ensuring a tight seal between intermediate blade $\mathbf{52}_2$ and the blades disposed on either side thereof. That is, as shown in FIG. 7, blade seals 66 cover the stops 36 and one end portion of two of the blades in the vicinity of their coupling. As a result, when three or more blades are employed in a single damper, the intermediate blades contain blade seals in positions whereby when the blades are in the closed position each coupling contains one blade seal.

Figure 8:
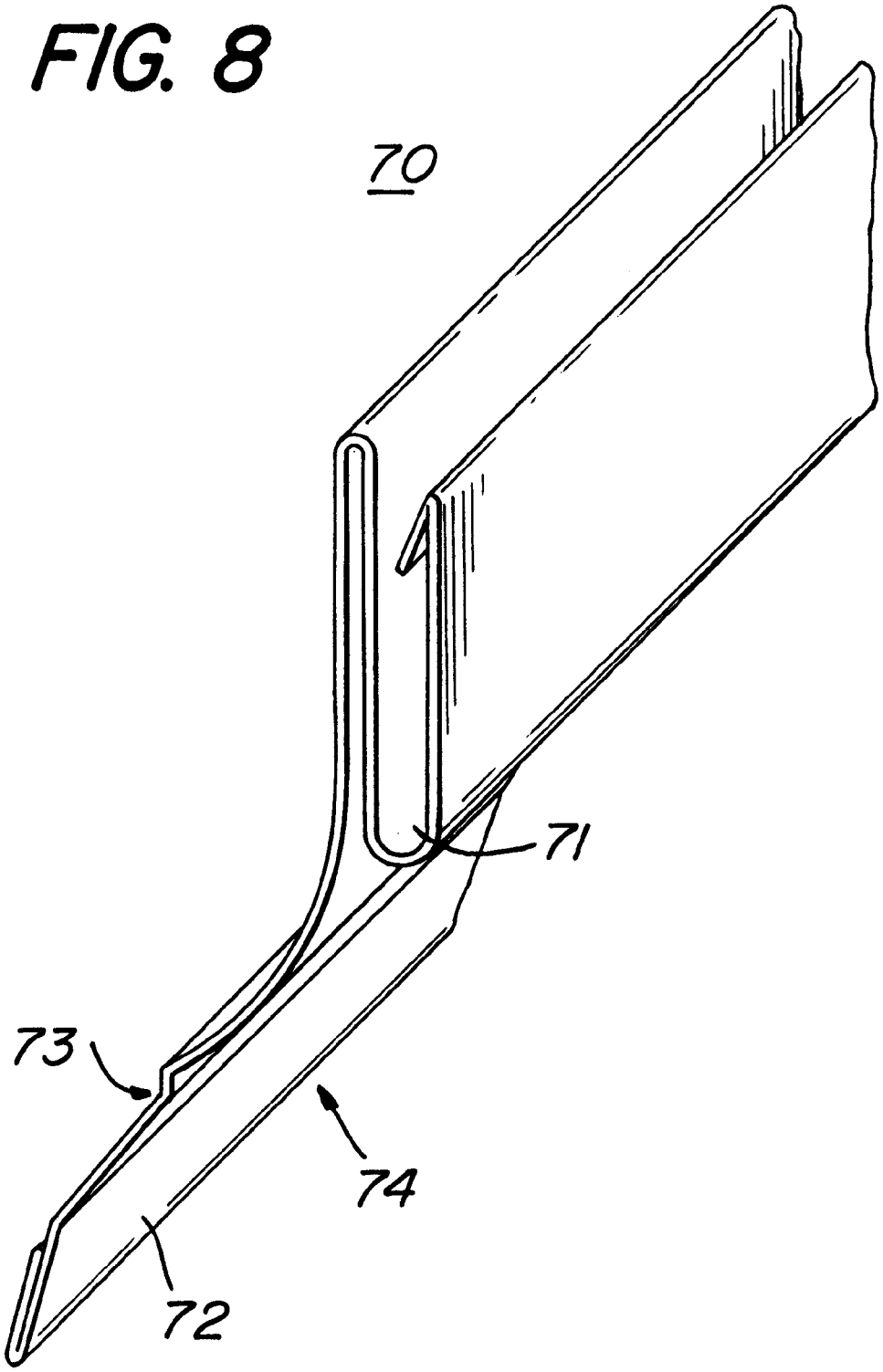
FIG. 8 is an isometric view of the blade seal of the present invention.

FIG. 8 is an isometric view of the blade seal 70 of the present invention. The blade seal 70 contains a U-shaped portion 71 and a flap portion 72. The blade seal 70 is attached to the stop 36 or the blade 16 in a manner whereby the stop 36 or the blade 16 is inserted into said U-shaped portion 71 of said seal 70. Said flap portion 72 contains an airflow side 73 and a seal side 74. When the seal 70 is attached to the stop 36 or the blade 16, the air flows against the airflow side 73 thereby causing the seal side 74 to press against the adjoining blade 16.

Although the illustrated embodiments of the present invention utilize a fusible link as the mechanism for releasing the flat-coil spring, it is to be understood that various other releasing arrangements can be used, as such direct actuation of the central rod disposed through the flat-coil spring. In general, the spirit and scope of the present invention is limited only by the scope of claims appended hereto.

What is claimed is:

1. A smoke and fire damper comprising a frame structure sized to insert within and completely encase an air passageway within a building, said frame defined as including a top wall, a bottom wall, and a pair of sidewalls, said frame comprising a frame top surface and a frame bottom surface, both of which top and bottom surfaces include a stop;

at least one blade;

a plurality of blade seals, said blade seals each containing a U-shaped portion, said blade and said stops being insertable in said U-shaped portion, said blade seals each further comprising a flap, said flap sealing said blades when said blades are in the closed position;

a central pivot member attached to said at least one blade, the opposing ends of said central pivot member attached to the opposite side walls of said frame structure;

a flat-coil spring defined as including a first, rotating end and a second, fixed end;

an actuating arrangement attached to the first, rotating end of said flat-coil spring for holding said flat-coil spring under tension until a predetermined fire or smoke situation exists and thereafter actuating the movement of said flat-coil spring;

a pivot arrangement coupled between the first, rotating end and said at least one blade for holding said at least one blade in an "open" position essentially parallel with the frame top and bottom walls when said spring is under tension, and, when said spring is released, rotating said blade into a "closed" position essentially perpendicular with the frame top and bottom walls.

2. A fire and smoke damper as defined in claim 1 wherein the flat-coil spring is disposed on a first side of said damper and supported by a rod assembly including a pair of brackets attached to the frame sidewalls and a rod disposed between said brackets, said flat-coil spring surround said rod.

3. A fire and smoke damper as defined in claim 2 wherein the actuating arrangement comprises a fusible link coupled between the rod and the first, rotating end of the flat-coil spring.

4. A fire and smoke damper as defined in claim 1 wherein the pivot arrangement comprises a pivot arm coupled at a first end to the first, rotating end of said flat-coil spring; and a blade link, said blade link attached between said at least one blade and the remaining, opposite end of said pivot arm.

5. A fire and smoke damper as defined in claim 1 wherein the at least one blade comprises a single blade.

6. A fire and smoke damper as defined in claim 1 wherein the at least one blade comprises a plurality of blades, disposed in a contiguous arrangement such that in the closed position a first blade of said plurality of blades contacts the frame top surface, a last blade of said plurality of blades contacts the frame bottom surface, and the intermediate blades contact each other so as to provide the necessary closure.

7. A fire and smoke damper as defined in claim 6 wherein, in the closed position, a first blade of said plurality of blades contacts said stop on said frame top surface and a last blade of said plurality of blades contacts said stop on said frame bottom surface.

8. A fire and smoke damper as defined in claim 1, wherein in one of said blade seals is attached to said stop on said frame top surface, one of said plurality of blade seals is attached to said stop on said plurality of frame bottom surface, and wherein said intermediate blades are attached to said blade seals where said intermediate blades contact each other so as to provide the necessary closure.

9. A fire and smoke damper as defined in claim 7 wherein the damper further comprises a plurality of blade links for activating each blade and an interconnecting member attached to each link for providing the simultaneously movement of the plurality of blades.

* * * * *